US009963756B2

(12) United States Patent
Zhu et al.

(10) Patent No.: US 9,963,756 B2
(45) Date of Patent: May 8, 2018

(54) METHOD FOR PRODUCTION OF MARTENSITIC STEEL HAVING A VERY HIGH YIELD POINT AND SHEET OR PART THUS OBTAINED

(75) Inventors: Kangying Zhu, Metz (FR); Olivier Bouaziz, Metz (FR)

(73) Assignee: ARCELORMITTAL INVESTIGACIÓN Y DESARROLLO, S.L., Sestao, Bizkaia (ES)

( * ) Notice: Subject to any disclaimer, the term of this patent is extended or adjusted under 35 U.S.C. 154(b) by 338 days.

(21) Appl. No.: 14/116,980

(22) PCT Filed: Apr. 20, 2012

(86) PCT No.: PCT/FR2012/000156

§ 371 (c)(1),
(2), (4) Date: Feb. 14, 2014

(87) PCT Pub. No.: WO2012/153013

PCT Pub. Date: Nov. 15, 2012

(65) Prior Publication Data

US 2014/0144559 A1 May 29, 2014

(30) Foreign Application Priority Data

May 12, 2011 (WO) ..... PCT/FR2011/000295

(51) Int. Cl.
*C21D 8/02* (2006.01)
*C21D 9/46* (2006.01)
(Continued)

(52) U.S. Cl.
CPC ..... *C21D 8/0263* (2013.01); *C21D 6/005* (2013.01); *C21D 8/0205* (2013.01);
(Continued)

(58) Field of Classification Search
CPC .. C21D 8/0205; C21D 8/0226; C21D 8/0263; C21D 9/46; C22C 38/12; C22C 38/22;
(Continued)

(56) References Cited

U.S. PATENT DOCUMENTS 4,619,714 A * 10/1986 Thomas ..... C21D 8/0226 148/320
6,264,760 B1 * 7/2001 Tamehiro et al. ..... 148/336
(Continued)

FOREIGN PATENT DOCUMENTS

CN 1106070 A 8/1995
CN 1282381 A 1/2001
(Continued)

*Primary Examiner* — Keith Walker
*Assistant Examiner* — John A Hevey
(74) *Attorney, Agent, or Firm* — Davidson, Davidson & Kappel, LLC; Jennifer L. O'Connell; William C. Gehris

(57) ABSTRACT

The present invention provides a method for the fabrication of a martensitic steel sheet with a yield stress greater than 1300 MPa. The method includes the steps of obtaining a semi-finished steel product, the composition of which includes, whereby the contents are expressed in percent by weight: 0.15%≤C≤0.40%, 1.5%≤Mn≤3%, 0.005%≤Si≤2%, 0.005%≤Al≤0.1%, S≤0.05%, P≤0.1%, 0.025%≤Nb≤0.1%, and optionally: 0.01%≤Ti≤0.1%, 0%≤Cr≤4%, 0%≤Mo≤2%, 0.0005%≤B≤0.005%, 0.0005%≤Ca≤0.005%. The remainder of the composition is iron and the inevitable impurities resulting from processing. The semi-finished product is reheated to a temperature $T_1$ in the range between 1050° C. and 1250° C., then the reheated semi-finished product is subjected to a roughing rolling at a temperature $T_2$ in the range between 1050 and 1150° C., with a cumulative rate of reduction $\epsilon_a$ greater than 100%, to obtain a sheet with a not totally recrystallized austenitic structure with an average grain size less than 40 micrometers and preferably less than 5 micrometers. The sheet is then cooled to prevent a
(Continued)

transformation of the austenite at a rate $V_{R1}$ greater than 2° C./s to a temperature $T_3$ in the range between 970° C. and Ar3+30° C., is then subjected to a finishing hot rolling at the temperature $T_3$ of the cooled sheet, with a cumulative rate off reduction $\epsilon_b$ greater than 50% to obtain a sheet, then the sheet is cooled at a rate $V_{R2}$ which is greater than the critical martensitic quenching rate. Steel sheets are also provided.

11 Claims, 1 Drawing Sheet

(51) Int. Cl.

| | |
|---|---|
| ***C22C 38/02*** | (2006.01) |
| ***C22C 38/04*** | (2006.01) |
| ***C22C 38/38*** | (2006.01) |
| ***C22C 38/06*** | (2006.01) |
| ***C21D 6/00*** | (2006.01) |
| ***C22C 38/00*** | (2006.01) |
| ***C22C 38/12*** | (2006.01) |
| ***C22C 38/14*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |

(52) U.S. Cl.
CPC ..... *C21D 8/0226* (2013.01); *C21D 9/46* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/26* (2013.01); *C22C 38/28* (2013.01); *C22C 38/32* (2013.01); *C22C 38/38* (2013.01); *C21D 2211/008* (2013.01)

(58) Field of Classification Search
CPC ..... C22C 38/26; C22C 38/02; C22C 38/04; C22C 38/06; C22C 38/38
See application file for complete search history.

(56) References Cited

U.S. PATENT DOCUMENTS

| | | | | |
|---|---|---|---|---|
| 2008/0017283 | A1* | 1/2008 | Maruta et al. | 148/579 |
| 2010/0230016 | A1 | 9/2010 | Kumagai | |
| 2011/0253271 | A1* | 10/2011 | Kumagai et al. | 148/645 |
| 2011/0259481 | A1* | 10/2011 | Hong et al. | 148/564 |
| 2013/0095347 | A1* | 4/2013 | Kawasaki | B32B 15/013 428/684 |

FOREIGN PATENT DOCUMENTS

| | | | |
|---|---|---|---|
| CN | 101586217 | A | 11/2009 |
| CN | 101676425 | A | 3/2010 |
| EP | 2290116 | | 3/2011 |
| JP | S63134628 | A | 6/1988 |
| JP | H01275719 | A | 11/1989 |
| JP | 2004010971 | A | 1/2004 |
| JP | 2008208454 | A | 9/2008 |
| JP | 2009215576 | A | 9/2009 |
| JP | 2010132945 | | 6/2010 |
| JP | 2010159466 | A | 7/2010 |
| JP | 2010229512 | A | 10/2010 |
| JP | 2011052321 | A | 3/2011 |
| JP | 2010106287 | A | 5/2013 |
| WO | 9932672 | A1 | 7/1999 |
| WO | WO 2010055609 | * | 5/2010 |

* cited by examiner

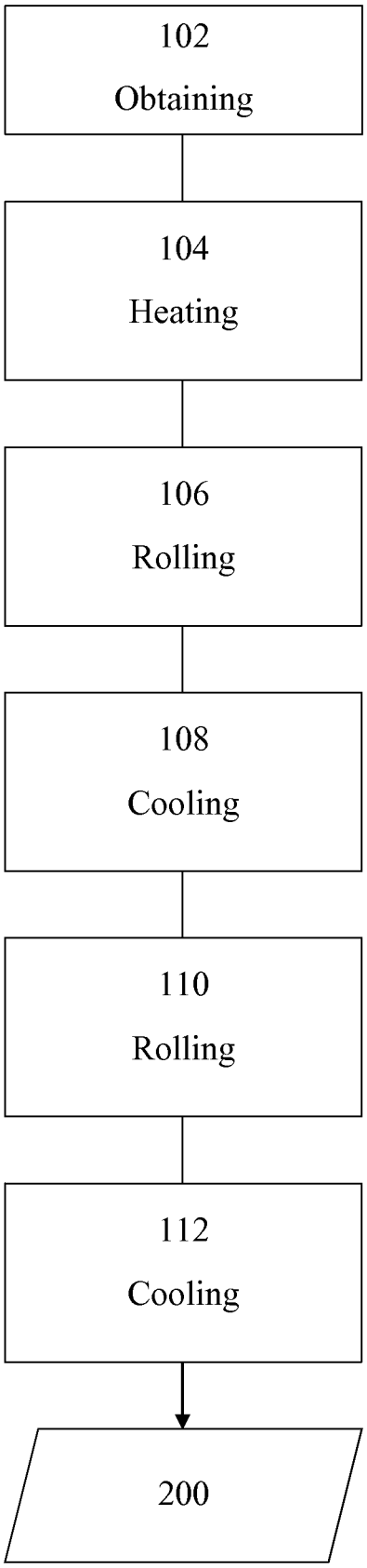
102
Obtaining
104
Heating
106
Rolling
108
Cooling
110
Rolling
112
Cooling
200

METHOD FOR PRODUCTION OF MARTENSITIC STEEL HAVING A VERY HIGH YIELD POINT AND SHEET OR PART THUS OBTAINED

This invention relates to a method for the fabrication of steel sheet with a martensitic structure with mechanical strength greater than that which could be obtained by a simple rapid cooling treatment with martensitic quenching. The steel sheet also includes mechanical strength and elongation properties that make it possible to use the steel sheet in the fabrication of energy-absorbing parts in automotive vehicles.

BACKGROUND

In certain applications, pieces are manufactured from steel sheet which has very high mechanical strength. This type of combination is particularly desirable in the automobile industry, where attempts are being made to significantly reduce the weight of the vehicles. This weight reduction can be achieved with the use of steel parts with very high mechanical characteristics and a martensitic microstructure. Anti-intrusion and structural parts, as well as other parts that contribute to the safety of automotive vehicles such as: bumpers, door or center pillar reinforcements and wheel arms, for example, require such characteristics. The thickness of these parts is preferably less than 3 millimeters.

Sheets that have even greater mechanical strength are desired. The ability to increase the mechanical strength of a steel with a martensitic structure by means of an addition of carbon is well known. However, this higher carbon content reduces the weldability of the sheets or of the parts fabricated from these sheets and increases the risk of cracking linked to the presence of hydrogen.

SUMMARY OF THE INVENTION

It is therefore desirable to have a method for the fabrication of steel sheet that does not have the disadvantages mentioned above so that the steel sheet has an ultimate strength that is greater by more than 50 MPa than the strength that could be obtained by means of austenitization followed by a simple martensitic quenching of the steel in question. The inventors have shown that, for carbon contents ranging from 0.15 to 0.40% by weight, the ultimate tensile strength Rm of steel sheets fabricated by total austenitization followed by a simple martensitic quenching depends practically only on the carbon content and is linked to the carbon content with a very high degree of precision, as described in expression (1): Rm (megapascals)=3220(C)+908.

In this expression, (C) designates the carbon content of the steel expressed in percent by weight. At a given carbon content C of a steel, an objective of the present invention is therefore to have a fabrication method that makes it possible to obtain an ultimate strength greater than 50 MPa in expression (1), i.e. a strength greater than 3220(C)+958 Mpa for this steel. Another objective of the present invention is to have a method that makes possible the fabrication of steel sheet with a very high yield stress, i.e. greater than 1300 MPa. A further objective is also to have a method that makes it possible to fabricate steel sheet that can be used immediately, i.e. without the necessity for a tempering treatment after quenching.

The steel sheet must be weldable using conventional welding methods and must not require the addition of expensive alloy elements.

An object of the present invention is to resolve the problems cited above. A preferred object of the present invention is provide steel sheet with a yield stress greater than 1300 MPa, mechanical tensile strength, expressed in megapascals, greater than (3220)(C)+958 MPa and preferably a total elongation greater than 3%.

To this end, the present invention provides a method for the fabrication of a martensitic steel sheet with a yield stress greater than 1300 MPa which includes the steps listed below, in the order listed below, in which:

- a semi-finished steel product is obtained, the composition of which is as follows, whereby the contents are expressed by weight, 0.15%≤C≤0.40%, 1.5%≤Mn≤3%, 0.005%≤Si≤2%, 0.005%≤Al≤0.1%, S≤0.05%, P≤0.1%, 0.025%≤Nb≤0.1% and optionally: 0.01%≤Ti≤0.1%, 0%≤Cr≤4%, 0%≤Mo≤2%, 0.0005%≤B≤0.005%, 0.0005%≤Ca≤0.005%, the remainder of the composition consisting of iron and the inevitable impurities resulting from processing.
- the semi-finished product is heated to a temperature $T_1$ between 1050° C. and 1250° C., then
- the reheated semi-finished product is rolled in a roughing mill at a temperature $T_2$ between 1050 and 1150° C. with a cumulative reduction rate $\epsilon_a$ greater than 100% to obtain a sheet with an austenitic structure, not fully recrystallized, with an average grain size of less than 40 micrometers, then
- the sheet is cooled incompletely to a temperature $T_3$ between 970° C. and Ar3+30° C. to prevent a transformation of the austenite, at a rate $V_{R1}$ greater than 2° C./s, then
- the incompletely cooled sheet is rolled in a finishing mill at the temperature $T_3$ with a cumulative reduction rate $\epsilon_b$ which is greater than 50% to obtain a sheet, then,
- the sheet is cooled at a rate $V_{R2}$ which is greater than the critical martensitic quenching rate.

In a preferred embodiment, the average size of the austenite grains is less than 5 micrometers.

The sheet is preferably subjected to a further tempering heat treatment at a temperature $T_4$ in the range between 150 and 600° C. for a period of between 5 and 30 minutes.

The present invention also provides an untempered steel sheet with a yield stress greater than 1300 MPa obtained by a method as in one of the fabrication modes described above with a totally martensitic structure which has an average lath grain size of less than 1.2 micrometers, whereby the average elongation factor of the laths is between 2 and 5.

The present invention further provides a steel sheet obtained via the method with the tempering treatment described above, whereby the steel has a totally martensitic structure with an average lath grain size of less than 1.2 micrometers, whereby the average elongation factor of the laths is between 2 and 5.

BRIEF DESCRIPTION OF THE FIGURE

Additional characteristics and advantages of the present invention will be made clear in the following description, which is provided by way of example, and refers to the accompanying FIGURE, in which the FIGURE shows a steel sheet fabricated by a method of the present invention;

DETAILED DESCRIPTION

The composition of the steels used in the method claimed by the invention is described in greater detail below.

When the carbon content of the steel is less than 0.15% by weight, the hardenability of the steel is insufficient, and it is not possible to obtain a totally martensitic structure, taking the method used into account. When this content is greater than 0.40%, the welded joints fabricated from these sheets, or these parts, exhibit insufficient toughness. The optimum carbon content for a preferred embodiment of the present invention is between 0.16 and 0.28%, preferably.

Manganese lowers the temperature at which the martensite begins to form and slows down the decomposition of the austenite. To achieve sufficient effects, the manganese content must not be less than 1.5%. In addition, when the manganese content exceeds 3%, segregated zones are present in excessive quantities, which has an adverse effect on the performance of a preferred method of the present invention. A preferred range for the performance of the method claimed by the invention is 1.8 to 2.5% Mn.

The silicon content must be greater than 0.005% to participate in the deoxidation of the steel in the liquid phase. The silicon content must not exceed 2%, preferably, by weight on account of the formation of surface oxides which significantly reduce the coatability, if the intent is to coat the sheet by passing it through a metal coating bath, in particular by continuous hot-dip galvanizing.

The aluminum content of the steel according to a preferred embodiment of present invention is not less than 0.005% so as to achieve a sufficient deoxidation of the steel in the liquid state. Casting problems can occur when the aluminum content is greater than 0.1% by weight. Alumina inclusions can also be formed in excessive quantities or size, which have an undesirable effect on the toughness.

The levels of sulfur and phosphorus in the steel are limited to 0.05 and 0.1% respectively to prevent a reduction of the ductility or the toughness of the parts or of the sheets fabricated according to the present invention.

The steel also includes niobium in a quantity between 0.025 and 0.1%, and optionally titanium in a quantity between 0.01 and 0.1%.

These additions of niobium and optionally of titanium make it possible to use a preferred method of the present invention by slowing down the recrystallization of the austenite at high temperature and make it possible to achieve sufficiently fine grain size at high temperature.

Chromium and molybdenum are elements that are very effective at retarding the transformation of the austenite and can optionally be used for the performance of a preferred method of the present invention. The effect of these elements is to separate the ferrite-pearlite and bainite transformation range, whereby the ferrite-pearlite transformation occurs at temperatures higher than the bainite transformation. These transformation ranges then occur in the form of two distinct "noses" in an isothermal transformation diagram (Transformation-Temperature-Time).

The chromium content must be less than or equal to 4%. Above this level, its effect on hardenability is practically saturated; any further addition is expensive and produces no corresponding beneficial effect.

However, the molybdenum content must not exceed 2%, on account of its excessive cost. Optionally, the steel can also contain boron; the significant deformation of the austenite can accelerate the transformation into ferrite during cooling, a phenomenon which must be prevented. An addition of boron, in a range between 0.0005 and 0.005% by weight, provides a hedge against premature ferrite transformation.

Optionally, the steel can also contain calcium in a quantity between 0.0005 and 0.005%; by combining with oxygen and sulfur, the calcium makes it possible to prevent the formation of large inclusions, which have an undesirable effect on the ductility of the sheets or the parts fabricated from them.

The remainder of the composition of the steel consists of iron and the inevitable impurities resulting from processing.

The steel sheets fabricated in accordance with the present invention are include a totally martensitic structure with very fine laths; on account of the thermo-mechanical cycle and the specific composition, the average size of the martensitic laths is less than 1.2 micrometers and their average coefficient of elongation is between 2 and 5. These microstructural characteristics are determined, for example, by observing the microstructure via a Scanning Electron Microscope by means of a field emission gun (the "MEB-FEG") technique at a magnification greater than 1200×, coupled with an EBSD ("Electron Backscatter Diffraction") detector. Two contiguous laths are defined as separate when their misorientation is greater than 5 degrees. The average size of the laths is defined by the intercepts method, which is in itself known; the average size of the laths intercepted by the lines defined randomly with respect to the microstructure is evaluated. The measurement is taken over at least 1000 martensitic laths to obtain a representative average value. The morphology of the individualized laths is then determined by image analysis using software which is in itself known; the maximum dimension $l_{max}$ and minimum $l_{min}$ dimension of each martensitic lath are determined, as well as its elongation factor $$\frac{l\max}{l\min}.$$

To be statistically representative, this observation must include at least 1000 martensitic laths. The average elongation factor $$\frac{\overline{l\max}}{\overline{l\min}}$$

is then determined for all of these laths observed.

The method for the fabrication of hot-rolled sheet in accordance with a preferred embodiment of the present invention and shown in the FIGURE, includes the following steps.

First, a semi-finished steel product having the composition specified above is obtained 102. This semi-finished product can be in the form of a continuously cast slab, for example, or a thin slab or an ingot. By way of a non-restrictive example, a continuously cast slab has a thickness on the order of 200 mm, and a thin slab a thickness on the order of 50-80 mm. This semi-finished product is heated to a temperature $T_1$ between 1050° C. and 1250° C. 104. The temperature $T_1$ is higher than $A_{c3}$, the total austenite transformation temperature during heating. This heating therefore makes it possible to obtain a complete austenitization of the steel as well as the dissolution of any niobium carbonitrides that may be present in the semi-finished product. This heating step also makes it possible to carry out the additional hot-rolling operations that are described below. The semi-finished product is subjected to a roughing rolling 106. This roughing rolling is performed at a temperature $T_2$ between 1050 and 1150° C. The cumulative rate of reduction of the different roughing rolling steps is designated $\epsilon_a$. If $e_{in}$ designates the thickness of the semi-finished product prior to the hot roughing rolling, and $e_{fa}$ the thickness of the sheet after this rolling, the cumulative reduction rate is defined by $$\varepsilon_a = \mathrm{Ln}\frac{e_{ia}}{e_{fa}}.$$

The invention teaches that the rate of reduction $\epsilon_a$ must be greater than 100%, i.e. greater than 1. Under these rolling conditions, the presence of niobium, and optionally of titanium, retards the recrystallization and makes it possible to obtain an austenite that is not totally recrystallized at high temperature. The average austenitic grain size thus obtained is less than 40 micrometers, or even less than 5 micrometers when the niobium content is between 0.030 and 0.050%. This grain size can be measured, for example, by means of tests where the sheet is tempered immediately after rolling. A polished and etched section of the sheet is then observed. The etching is performed using a reagent which is in itself known, such as, for example, the Béchet-Beaujard reagent which reveals the former austenitic grain boundaries.

The sheet is then cooled, although not completely, i.e. to an intermediate temperature $T_3$, at a rate $V_{R1}$ which is greater than 2° C./s, to prevent a transformation and potential recrystallization of the austenite 108, and then the sheet is hot-rolled on a finishing mill with a cumulative rate of reduction $\epsilon_b$ which is greater than 50% 110. If $e_{i2}$ designates the thickness of the sheet before the finish rolling and $e_{f2}$ the thickness of the sheet after this rolling, the cumulative rate of reduction is defined by $$\varepsilon_b = \mathrm{Ln}\frac{e_{i_b}}{e_{fb}}.$$

This finish rolling is performed at a temperature $T_3$ between 970 and Ar3+30° C., where Ar3 designates the temperature of the start of the austenite transformation during cooling. This makes it possible to obtain, at the end of the finish rolling, a deformed fine-grained austenite which does not have a tendency to recrystallize. This sheet is then cooled at a rate $V_{R2}$ which is greater than the critical martensite quenching rate 112, and the result is a sheet 200 characterized by a very fine martensitic structure, the mechanical properties of which are superior to the properties that can be obtained by a simple thermal quenching treatment.

Although the above method describes the fabrication of sheets, i.e. of flat products on the basis of slabs, the present invention is not limited to this geometry or this type of product, and can also be adapted to the fabrication of long products, bars and shapes, by subsequent hot-forming steps. The steel sheet can be utilized as is or can be subjected to a thermal tempering treatment at a temperature $T_4$ between 150 and 600° C. for a period of time between 5 and 30 minutes. This tempering treatment generally increases the ductility at the expense of a reduction in the yield stress and strength. However, the inventors have shown that a method according to the present invention, which gives the steel a mechanical tensile strength which is at least 50 MPa higher than the strength that can be obtained after conventional quenching preserves this advantage, even after a tempering treatment with temperatures that can range from 150 to 600° C. The fineness characteristics of the microstructure are preserved by this temper annealing treatment.

The following results, which are presented by way of a non-restrictive example, demonstrate the advantageous characteristics achieved by the invention.

Example

Semi-finished steel products are obtained containing the elements listed below, expressed in percent (%) by weight:

| | C | Mn | Si | Cr | Mo | Al | S | P | Nb | Ti | B | Ca |
|---|---|---|---|---|---|---|---|---|---|---|---|---|
| A | 0.27 | 1.91 | 0.01 | 0.01 | 0.01 | 0.03 | 0.003 | 0.020 | 0.042 | 0.010 | 0.0016 | 0.001 |
| B | 0.198 | 1.94 | 0.01 | 1.909 | 0.01 | 0.03 | 0.003 | 0.020 | 0.003 | 0.012 | 0.0014 | 0.0004 |

The underlined values are not in conformance with the invention

Semi-finished products 31 mm thick were reheated and held for 30 minutes at a temperature $T_1$ of 1250° C., then subjected to rolling in 4 passes at a temperature $T_2$ of 1100° C. with a cumulative reduction rate $\epsilon_1$ of 164%, i.e. to a thickness of 6 mm. At this stage, at the high temperature after the roughing rolling, the structure is totally austenitic, not completely recrystallized and with an average grain size of 30 micrometers. The sheet thus obtained was then cooled at a rate of 3° C. to a temperature $T_3$ in the range between 955° C. and 840° C., whereby this latter temperature is equal to Ar3+60° C. the sheet was then rolled in this temperature range in 5 passes with a cumulative reduction rate $\epsilon_b$ of 76%, i.e. to a thickness of 2.8 mm, then cooled to the ambient temperature at a rate of 80° C./s to obtain a completely martensitic microstructure.

By comparison, steel sheets with the above composition were heated to a temperature of 1250° C., held at this temperature for 30 minutes and then cooled with water to obtain a completely martensitic microstructure (reference condition).

By means of tensile tests, the yield stress Re, the ultimate strength Rm and the total elongation A of the sheets obtained by these different modes of fabrication was determined. The following table also shows the estimated value of the strength after simple martensitic quenching (3220(C)+908 (MPa) as well as the difference ΔRm between this estimated value and the resistance actually measured.

| Steel | Test | Reduction temperature $T_3$ (° C.) | Re (MPa) | Rm (MPa) | A (%) | 3220 (C) + 908 (MPa) | ΔRm (MPa) |
|---|---|---|---|---|---|---|---|
| A | A1 | 955 | 1410 | 1840 | 5.2 | 1777 | 63 |
| | A2 | 860 | 1584 | 1949 | 4.9 | 1777 | 172 |
| B | B1 | 840 | 1270 | 1692 | 6.5 | 1545 | 147 |
| | B2 | None | 1223 | 1576 | 6.9 | 1545 | 31 |

Test conditions and mechanical results obtained
Underlined values: not in conformance with the invention Steel B does not contain sufficient niobium: In that case, a yield stress of 1300 MPa is not achieved, and even after simple martensitic quenching (test B2) only in the case of rolling with roughing and finishing at the temperature $T_3$ (test B1).

In the case of test B2 (simple martensitic quenching), it is observed that the strength value estimated (1545 Mpa) on the basis of expression (1) is close to that determined experimentally (1576 MPa).

The microstructure of the sheet obtained was also observed by means of Scanning Electron Microscopy with a field emission gun ("MEB-FEG" technique) and an EBSD detector. The average size of the laths of the martensitic structure as well as their average elongation factor $$\frac{\overline{l_{max}}}{\overline{l_{min}}}$$

was also quantified.

In tests A1 and A2, a method of the present invention makes it possible to obtain a martensitic structure with an average lath size of 0.9 micrometers and an elongation factor of 3. This structure is significantly finer than the one observed after simple martensitic quenching, where the average size of the laths is on the order of 2 micrometers.

In tests A1 and A2 claimed by the invention, the values of ΔRm are respectively 63 and 172 MPa. A method of the present invention therefore makes it possible to obtain mechanical strength values which are significantly higher than those that would be obtained by simple martensitic quenching. In the case of test A2, for example, this increase in strength (172 MPa) is equivalent to that which would be obtained, according to expression (1), thanks to a simple martensitic quenching applied to steels to which an additional approximately 0.05%. However, an increase of this type in the carbon content would have undesirable consequences in terms of weldability and toughness, although a preferred method of the present invention makes it possible to increase the mechanical strength without these disadvantages.

Sheets fabricated in accordance with the present invention, on account of its lower carbon content, have good suitability for welding using the usual methods, in particular spot resistance welding. They also have a good suitability for being coated, for example by hot-dip galvanizing or aluminum plating.

The present invention therefore makes possible the fabrication of bare or coated sheet with very high mechanical characteristics under very satisfactory economic conditions.

What is claimed is:

1. A method for the fabrication of a martensitic steel sheet with a yield stress greater than 1300 MPa, comprising the steps of:

obtaining a semi-finished steel product, a composition of the semi-finished steel product being as follows, whereby the contents are expressed by weight,
0.15%≤C≤0.40%,
1.5%≤Mn≤3%,
0.005%≤Si≤2%,
0.005%≤Al≤0.1%,
S≤0.05%,
P≤0.1%; and
0.025%≤Nb≤0.1%, the remainder of the composition comprising iron and the inevitable impurities resulting from processing;

heating the semi-finished product to a temperature $T_1$ between 1050° C. and 1250° C.;

rolling the reheated semi-finished product in a roughing mill at a temperature $T_2$ between 1050 and 1150° C. with a cumulative reduction rate $\epsilon_a$ greater than 100% to obtain a sheet with an austenitic structure, not fully recrystallized, with an average grain size of less than 40 micrometers;

partially cooling the sheet, to a temperature $T_3$ between 970° C. and Ar3+30° C. at a rate VR1 greater than 2° C./s;

rolling the partially cooled sheet in a finishing mill at the temperature $T_3$ with a cumulative reduction rate $\epsilon_b$ which is greater than 50% to obtain a sheet having a thickness of 3 mm or less;

cooling the sheet at a rate $V_{R2}$ which is greater than a critical martensitic quenching rate.

2. The method for the fabrication of a steel sheet as recited in claim 1, wherein the average austenitic grain size is less than 5 micrometers.

3. The method for the fabrication of a steel sheet as recited in claim 1, further comprising subjecting the sheet to a tempering heat treatment at a temperature $T_4$ which is between 150 and 600° C. for a period of time between 5 and 30 minutes.

4. A steel sheet with a yield stress greater than 1300 MPa comprising:

a steel sheet having a thickness of 3 mm or less fabricated by the method recited in claim 1;

a completely martensitic structure with an average lath grain size being less than 1.2 micrometers; and an average elongation factor of the laths being between 2 and 5.

5. A steel sheet comprising:

a steel sheet having a thickness of 3 mm or less fabricated by the method recited in claim 3;

a completely martensitic structure with an average lath grain size being less than 1.2 micrometers; and an average elongation factor of the laths being between 2 and 5.

6. The method for the fabrication of a steel sheet as recited in claim 1, wherein the composition of the semi-finished steel product includes 0.01%≤Ti≤0.1%.

7. The method for the fabrication of a steel sheet as recited in claim 1, wherein the composition of the semi-finished steel product includes 0%≤Cr≤4%.

8. The method for the fabrication of a steel sheet as recited in claim 1, wherein the composition of the semi-finished steel product includes 0%≤Mo≤2%.

9. The method for the fabrication of a steel sheet as recited in claim 1, wherein the composition of the semi-finished steel product includes 0.0005%≤B≤0.005%.

10. The method for the fabrication of a steel sheet as recited in claim 1, wherein the composition of the semi-finished steel product includes 0.0005%≤Ca≤0.005%.

11. A method for the fabrication of a martensitic steel sheet with a yield stress greater than 1300 MPa, comprising the steps of:

obtaining a semi-finished steel product, a composition the semi-finished steel product being as follows, whereby the contents are expressed by weight,
0.15%≤C≤0.40%,
1.5%≤Mn≤3%,
0.005%≤Si≤2%,
0.005%≤Al≤0.1%,
S≤0.05%,
P≤0.1%;
0.025%≤Nb≤0.1%; and optionally:
0.01%≤Ti≤0.01%
0%≤Cr≤4%
0%≤Mo≤2%
0.0005%≤B≤0.005%,
0.0005%≤Ca≤0.005%, the remainder of the composition consisting of iron and the inevitable impurities resulting from processing;

heating the semi-finished product to a temperature $T_1$ between 1050° C. and 1250° C.;

rolling the reheated semi-finished product in a roughing mill at a temperature $T_2$ between 1050 and 1150° C. with a cumulative reduction rate $\epsilon_a$ greater than 100% to obtain a sheet with an austenitic structure, not fully recrystallized, with an average grain size of less than 40 micrometers;

partially cooling the sheet, to a temperature $T_3$ between 970° C. and Ar3+30° C. at a rate VR1 greater than 2° C./s;

rolling the partially cooled sheet in a finishing mill at the temperature $T_3$ with a cumulative reduction rate $\epsilon_b$ which is greater than 50% to obtain a sheet having a thickness of 3 mm or less;

cooling the sheet at a rate $V_{R2}$ which is greater than a critical martensitic quenching rate.

* * * * *